US008774658B2

(12) United States Patent
Miyahara et al.

(10) Patent No.: US 8,774,658 B2
(45) Date of Patent: Jul. 8, 2014

(54) IMAGE FORMING APPARATUS INCLUDING CONTROL UNIT THAT EXECUTES ENERGY CONTROL BY CONTROLLING BIASES

(75) Inventors: Kensuke Miyahara, Hekinan (JP); Takashi Yasuda, Nagoya (JP); Toshio Furukawa, Nagoya (JP); Yohei Nishimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 595 days.

(21) Appl. No.: 13/049,576

(22) Filed: Mar. 16, 2011

(65) Prior Publication Data

US 2011/0318028 A1 Dec. 29, 2011

(30) Foreign Application Priority Data

Jun. 24, 2010 (JP) ..... 2010-143466

(51) Int. Cl.

| | |
|---|---|
| ***G03G 15/02*** | (2006.01) |
| ***G03G 15/16*** | (2006.01) |
| ***G03G 15/01*** | (2006.01) |
| ***G03G 15/00*** | (2006.01) |

(52) U.S. Cl.

CPC ..... *G03G 15/0178* (2013.01); *G03G 15/1675* (2013.01); *G03G 15/5004* (2013.01); *G03G 15/0266* (2013.01)

USPC ..... 399/50; 399/66; 399/44

(58) Field of Classification Search

USPC ..... 399/44, 50, 66

See application file for complete search history.

(56) References Cited

U.S. PATENT DOCUMENTS

| | | | | |
|---|---|---|---|---|
| 6,321,059 | B1 | 11/2001 | Tamura | |
| 2001/0043817 | A1 | 11/2001 | Maebashi | |
| 2004/0141766 | A1 | 7/2004 | Toyama | |
| 2006/0072941 | A1 | 4/2006 | Furukawa | |
| 2008/0317506 | A1 | 12/2008 | Furukawa | |
| 2010/0080588 | A1 | 4/2010 | Fujikura | |
| 2011/0293301 | A1 * | 12/2011 | Hayakawa | 399/44 |

FOREIGN PATENT DOCUMENTS

JP 2001-166609 A 6/2001

(Continued)

OTHER PUBLICATIONS

JP Office Action dtd Apr. 10, 2012, JP Appln. 2010-143466, English translation.

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

An image forming apparatus includes: a first photosensitive drum for a monochrome printing mode; second and third photosensitive drums for a color printing mode; a moving unit moving a medium from the first photosensitive drum via the second photosensitive drum to the third photosensitive drum; charger devices for charging the photosensitive drums; transfer devices for transferring developer images on the photosensitive drums to the medium; and a control unit configured to control charging biases of the charger devices and transfer biases of the transfer devices. The control unit executes, in the monochrome printing mode, an energy saving control in which an absolute value of a charging bias applied to the charger device for the third photosensitive drum is smaller than an absolute value of a charging bias applied to the charger device corresponding to the second photosensitive drum.

15 Claims, 6 Drawing Sheets

| | ELECTRIC SURFACE POTENTIAL (V) | | | |
|---|---|---|---|---|
| | 51K | 51Y | 51M | 51C |
| COLOR MODE | 760 | 760 | 760 | 760 |
| MONOCHROME MODE | 760 | 760 | 100 | 100 |

| | WIRE CURRENT ($\mu$A) | | | |
|---|---|---|---|---|
| | 52WK | 52WY | 52WM | 52WC |
| COLOR MODE | 230 | 230 | 230 | 230 |
| MONOCHROME MODE | 230 | 230 | 30 | 30 |

(56) References Cited

FOREIGN PATENT DOCUMENTS

| | | |
|---|---|---|
| JP | 2001-342850 | 11/2001 |
| JP | 2002-357939 A | 12/2002 |
| JP | 2003-280318 A | 10/2003 |
| JP | 2004-012524 | 1/2004 |
| JP | 2004-151612 | 5/2004 |
| JP | 2006-098508 | 4/2006 |
| JP | 2009-003377 | 1/2009 |
| JP | 2010-085666 A | 4/2010 |

* cited by examiner

FIG. 4A

| | ELECTRIC SURFACE POTENTIAL (V) | | | |
|---|---|---|---|---|
| | 51K | 51Y | 51M | 51C |
| COLOR MODE | 760 | 760 | 760 | 760 |
| MONOCHROME MODE | 760 | 760 | 100 | 100 |

FIG. 4B

| | WIRE CURRENT ($\mu$A) | | | |
|---|---|---|---|---|
| | 52WK | 52WY | 52WM | 52WC |
| COLOR MODE | 230 | 230 | 230 | 230 |
| MONOCHROME MODE | 230 | 230 | 30 | 30 |

FIG. 6

| | ELECTRIC SURFACE POTENTIAL (V) | | | |
|---|---|---|---|---|
| | 51K | 51Y | 51M | 51C |
| COLOR MODE | 760 | 760 | 760 | 760 |
| MONOCHROME MODE (NORMAL HUMIDITY) | 760 | 760 | 100 | 100 |
| MONOCHROME MODE (HIGH HUMIDITY) | 760 | 760 | 760 | 760 |

IMAGE FORMING APPARATUS INCLUDING CONTROL UNIT THAT EXECUTES ENERGY CONTROL BY CONTROLLING BIASES

This application is based upon and claims the benefit of priority of Japanese Patent Application No. 2010-143466 filed on Jun. 24, 2010, the contents of which are incorporated herein by reference in its entirety.

BACKGROUND

The disclosure relates to an image forming apparatus having printing modes such as a monochrome printing mode and a color printing mode.

An electrophotographic color image forming apparatus includes a plurality of photosensitive drums and a plurality of developing cartridges in accordance with a plurality of types of toner having different colors. An electrostatic latent image is formed on the photosensitive drums, and the developing cartridges accommodate the corresponding type or color of toner therein and supply it to the electrostatic latent images formed on the photosensitive drums. In this color image forming apparatus, a sheet is conveyed along the photosensitive drums, whereby toner images of colors corresponding to the colors of toner formed on the photosensitive drums are transferred sequentially to the sheet.

As a color image forming apparatus like this, conventionally, a color image forming apparatus is known in which a photosensitive drum and a developing cartridge which are used in monochrome printing (normally, in black) are disposed at an upstreammost end of a sheet conveying direction.

SUMMARY

Incidentally, when monochrome printing is executed in the color image forming apparatus configured as described above, since photosensitive drums other than the photosensitive drum for monochrome printing are also brought into contact with the medium, there is caused a problem that the toner on the medium which has been transferred from the monochrome printing photosensitive drum disposed at the upstreammost end adheres (hereinafter, also referred to as reverse transfer) to the photosensitive drums aligned downstream of the monochrome printing photosensitive drum.

In the related art, this problem has been dealt with by restraining the reverse transfer by applying, even if monochrome printing is executed, a charging bias to the photosensitive drums other than the monochrome printing photosensitive drum to charge them so that electric surface potentials the photosensitive drums become equal to electric surface potentials given them if color printing is executed. However, if the charging bias equal to that given in color printing is applied to the photosensitive drums other than the monochrome printing photosensitive drum even in monochrome printing so as to charge them in the way described above, electric power is consumed wastefully, which is not preferable. However, although it is considered to decrease the charging bias given to the photosensitive drums for the second to fourth colors in monochrome printing in order to save energy, when this configuration is adopted, the problem of reverse transfer is caused again.

Then, an object of an aspect of the disclosure is to restrain the wasteful consumption of electric power while restraining the generation of reverse transfer in monochrome printing.

The aspect of the disclosure provides the following arrangements:

An image forming apparatus for forming an image on a medium, having a monochrome printing mode and a color printing mode, the image forming apparatus comprising:

a first photosensitive drum used in the monochrome printing mode;

a second photosensitive drum used in the color printing mode;

a third photosensitive drum used in the color printing mode, the first photosensitive drum, the second photosensitive drum and the third photosensitive drum being aligned sequentially in this order from an upstream side of a moving direction of the medium;

charger devices provided so as to correspond respectively to the first to third photosensitive drums for charging the photosensitive drums;

transfer devices provided so as to correspond respectively to the first to third photosensitive drums for transferring developer images on the photosensitive drums to the medium fed by a moving unit; and a control unit configured to control charging biases applied to the charger devices and transfer biases applied to the transfer devices, wherein the control unit executes, in the monochrome printing mode, an energy saving control in which absolute value of charging bias applied to the charger device corresponding to the third photosensitive drum is smaller than absolute value of charging bias applied to the charger device corresponding to the third photosensitive drum in the color printing mode and is smaller than an absolute value of a charging bias applied to the charger device corresponding to the second photosensitive drum.

An image forming apparatus for forming an image on a medium, having a monochrome printing mode and a color printing mode, the image forming apparatus comprising:

a first photosensitive drum used in the monochrome printing mode;

a second photosensitive drum used in the color printing mode;

a third photosensitive drum used in the color printing mode, the first photosensitive drum, the second photosensitive drum and the third photosensitive drum being aligned sequentially in this order from an upstream side of a moving direction of the medium;

charger devices provided so as to correspond respectively to the first to third photosensitive drums for charging the photosensitive drums;

transfer devices provided so as to correspond respectively to the first to third photosensitive drums for transferring developer images on the photosensitive drums to the medium fed by a moving unit; and a control unit configured to control charging biases applied to the charger devices and transfer biases applied to the transfer devices, wherein the control unit executes, in the monochrome printing mode, an energy saving control in which absolute value of charging bias applied to the charger device corresponding to the third photosensitive drum is smaller than absolute value of charging bias applied to the charger device corresponding to the third photosensitive drum in the color printing mode.

An image forming apparatus for forming an image on a medium, having a monochrome printing mode and a color printing mode, the image forming apparatus comprising:

a first photosensitive drum used in the monochrome printing mode;

a second photosensitive drum used in the color printing mode;

a third photosensitive drum used in the color printing mode, the first photosensitive drum, the second photosensitive drum and the third photosensitive drum being aligned sequentially in this order from an upstream side of a moving direction of the medium;

charger devices provided so as to correspond respectively to the first to third photosensitive drums for charging the photosensitive drums;

transfer devices provided so as to correspond respectively to the first to third photosensitive drums for transferring developer images on the photosensitive drums to the medium fed by a moving unit; and a control unit configured to control charging biases applied to the charger devices and transfer biases applied to the transfer devices, wherein the control unit executes, in the monochrome printing mode, an energy saving control in which absolute value of charging bias applied to the charger device corresponding to the third photosensitive drum is smaller than an absolute value of a charging bias applied to the charger device corresponding to the second photosensitive drum.

BRIEF DESCRIPTION OF THE DRAWINGS

FIGS. 4A and 4B show maps showing a form in which an energy saving control is executed in monochrome printing. FIG. 4A shows a map of electric surface potentials of photosensitive drums and FIG. 4B is a map of wire currents.

FIG. 6 is a map showing a form in which no energy saving control is executed when humidity is high in monochrome printing.

DESCRIPTION OF EXEMPLARY EMBODIMENTS

Figure 1:
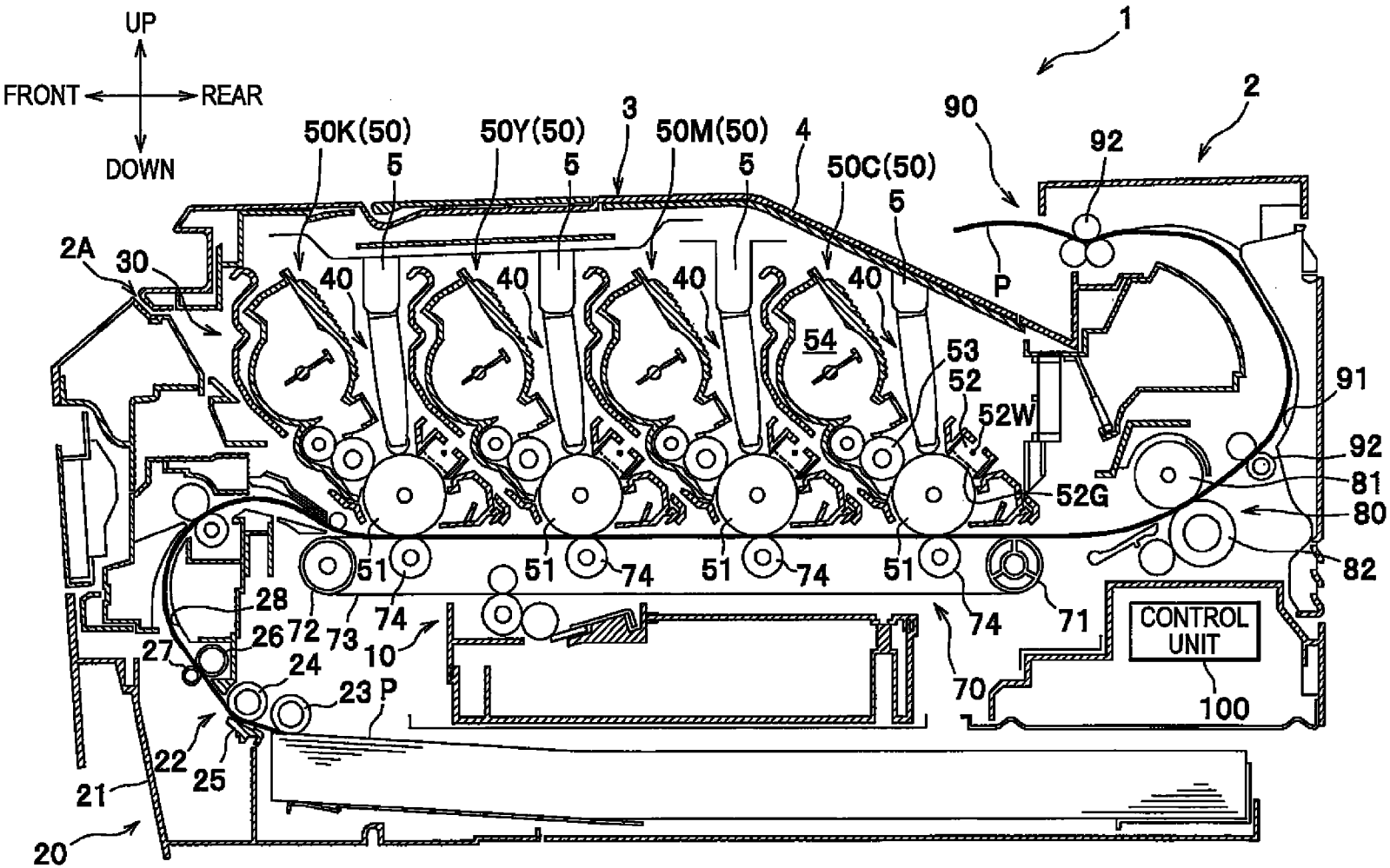
FIG. 1 is a side sectional view of an image forming apparatus according to an embodiment of the invention.

Next, an exemplary embodiment will be described in detail while referring to the drawings as required. In the next description, firstly, an overall configuration of a color printer will be described, and then a main part of the color printer will be described in detail.

In the following description, directions will be described based on the position of a user of a color printer. Namely, in FIG. 1, with the user standing to face the sheet of paper on which a side sectional view of a color printer is drawn, a left-hand side of the figure is referred to as a "front side," a right-hand side as a "rear side," a farther side as a "left-hand side," and a nearer side as a "right-hand side" of the color printer. In addition, Upward and downward directions of the figure are referred to as "upward and downward directions" of the color printer.

As is shown in FIG. 1, a color printer 1 includes a feeder unit 20 for feeding a sheet P as an example of a medium, an image forming unit 30 for forming an image on the sheet P fed, a sheet discharge part 90 for discharging the sheet P on which an image is formed and a control unit 100 within an apparatus main body 2.

An opening portion 2A is formed in an upper portion of the apparatus main body 2. The opening portion 2A is designed to be opened and closed by an upper cover 3 which is supported rotatably on the apparatus main body 2. An upper surface of the upper cover 3 is configured as a sheet discharging tray 4 where sheets P discharged from the apparatus main body 2 are accumulated. A plurality of LED mounting members 5 are provided on a lower surface of the upper cover 3, and LED units 40, which will be described later, are held on the LED mounting members 50.

The feeder unit 20 is provided at a lower portion within the apparatus main body 2 and includes a sheet feeding tray 21 which is detachably installed in the apparatus main body 2 and a sheet feeding mechanism 22 for conveying a sheet P from the sheet feeding tray 21 to the image forming unit 30. The sheet feeding mechanism 22 is provided at a front side of the sheet feeding tray 21 and includes a sheet feeding roller 23, a separation roller 24 and a separation pad 25.

In the sheet feeder unit 20 configured in the way described above, sheets P in the sheet feeding tray 21 are separated to be sent upwards sheet by sheet, and paper dust is removed from the sheet while the sheet P is passing between a paper dust removing roller 26 and a pinch roller 27. Thereafter, the sheet P passes through a conveying path 28 to thereby be turned to a reverse direction so as to be fed to the image forming unit 30.

The image forming unit 30 includes mainly four LED units 40, four process cartridges 50, a transfer unit 70, a cleaning part 10 and a fixing unit 80.

The LED units 40 are connected to the LED mounting members 5 so as to swing thereon and are supported while being positioned as required by a positioning member provided in the apparatus main body 2.

The process cartridges 50 are disposed to be aligned in a front-rear direction between the upper cover 3 and the feeder unit 20 and each include a photosensitive drum 51, a charger 52 as an example of a charging device, a developing roller 53, a toner accommodation compartment 54 for accommodating toner as an example of a developer and the like.

The process cartridges 50 are denoted by 50K, 50Y, 50M and 50C as accommodating black toner, yellow toner, magenta toner and cyan toner, respectively, and are aligned sequentially in this order from an upstream side of the conveying direction of sheet P (the moving direction of a recording medium). In the specification and the drawings, when specifying the photosensitive drums 51, the chargers 52, the developing rollers 53 and transfer rollers 74 in accordance with the toner colors, reference characters K, Y, M, C are added thereto so as to make them correspond to black, yellow, magenta and cyan, respectively.

In addition, in this embodiment, the black photosensitive drum 51K used in monochrome printing is also referred to as a "first photosensitive drum 51K." Further, the other photosensitive drums 51Y, 51M, 51C than the black one which are disposed downstream of the first photosensitive drum 51K and are used only in color printing are also referred to as "second and third photosensitive drums 51Y, 51M, 51C." Especially, the photosensitive drum 51Y is referred to as the second photosensitive drum 51Y and the photosensitive drums 51M and 51C are referred to as the third photosensitive drums.

The chargers 52 are provided so as to correspond respectively to the photosensitive drums 51 so as to charge the corresponding photosensitive drums 51. The chargers 51 each include a charging wire 52W and a grid electrode 52G which is disposed between the charging wire 52W and the photosensitive drum 51.

Figure 2:
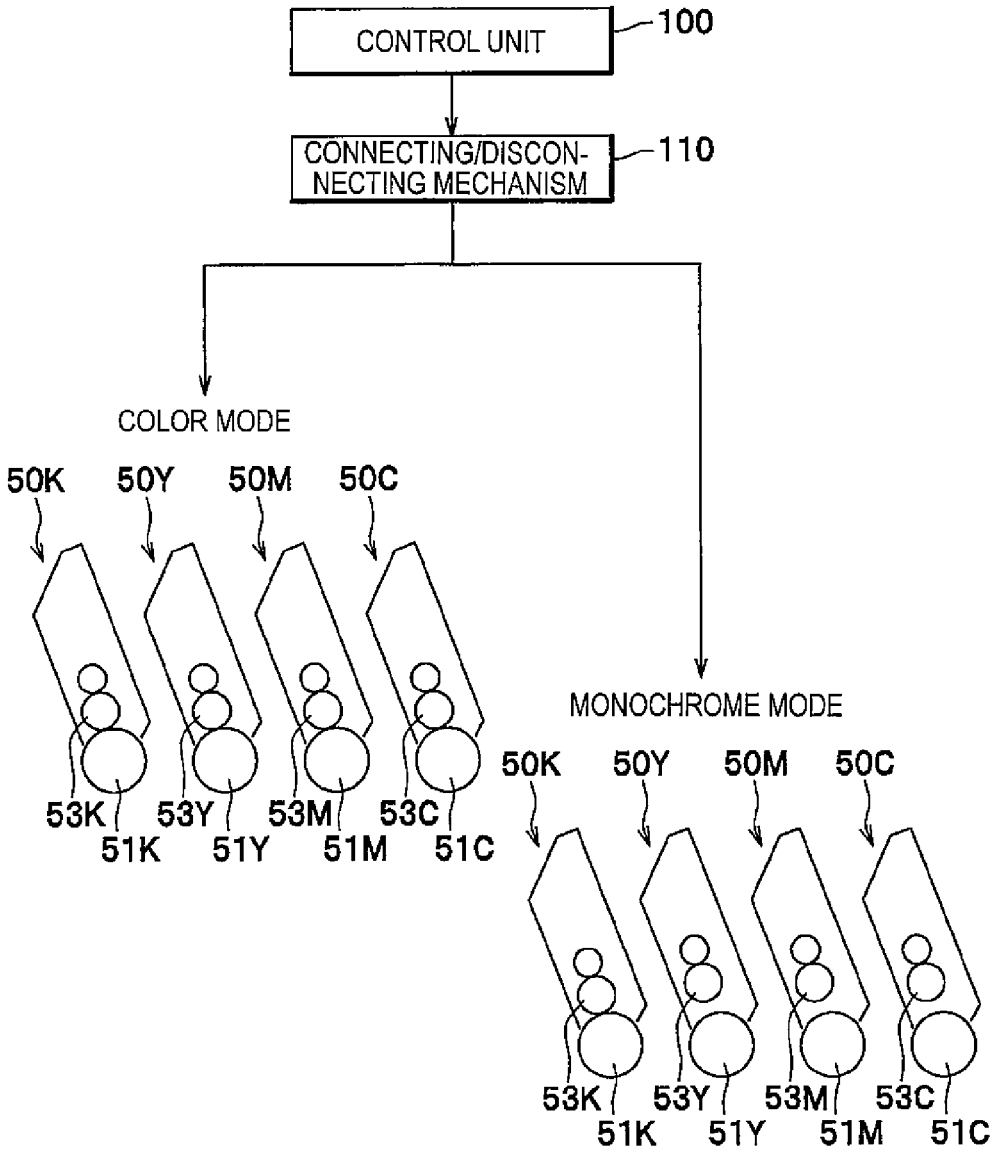
FIG. 2 is a drawing explaining the separation of photosensitive drums from developing rollers.

As is shown in FIG. 2, the developing rollers 53 are allowed to move towards or away from the corresponding photosensitive drums 51 by controlling a known connecting/disconnecting mechanism 110 (similar to a switching mechanism described in Japanese Patent Publication No. 2009-3377A (corresponding to US2008/0317506A1)) by the control unit 100. Specifically, in a color printing mode, all the developing rollers 53K, 53Y, 53M, 53C are brought into contact with the corresponding photosensitive drums 51K, 51Y, 51M, 51C, respectively so as to supply the corresponding toners to the photosensitive drums 51K, 51Y, 51M, 51C. In addition, in a monochrome printing mode, only the developing roller 53K for black (monochromic color) is brought into contact with the first photosensitive drum 51K, while the developing rollers 53Y, 53M, 53C for the remaining three colors are kept staying away from the corresponding second and third photosensitive drums 51Y, 51M, 51C.

As is shown in FIG. 1, the transfer unit 70 is provided between the feeder unit 20 and the process cartridges 50 and includes a driving roller 71, a driven roller 72, a conveying belt 73 and transfer rollers 74 as an example of a transfer member.

The driving roller 71 and the driven roller 72 are disposed in parallel while being spaced away from each other in the front-rear direction, and the conveying belt 73, which is made up of an endless belt, is provided to extend therebetween. An external surface of the conveying belt 73 is brought into contact with the photosensitive drums 51. Four transfer rollers 74 are provided inside the conveying belt 73 so as to be disposed to face respectively (correspond to) the photosensitive drums 51 to thereby hold the conveying belt 73 together with those photosensitive drums 51. A transfer bias (a transfer voltage) having a polarity different or opposite to the polarity of the toners charged is applied to the transfer rollers 74 at the time of transfer by a constant-current control.

The fixing unit 80 is disposed at the rear of the process cartridges 50 and the transfer unit 70 and includes a heating roller 81 and a pressing roller 82 which is disposed so as to face the heating roller 81 to thereby press the same roller 81.

In the image forming unit 30 configured in the way described above, in the case of the color printing mode, firstly the surfaces of the photosensitive drums 51 are uniformly charged by the corresponding chargers 52 and thereafter are exposed by the corresponding LED units 40. By this exposure, the electric potentials of portions of the photosensitive drums 51 which are so exposed are decreased, whereby electrostatic latent images based on image data are formed on the photosensitive drums 51. Thereafter, toner images are carried on the photosensitive drums 51 by the toners being supplied to the electrostatic latent images by the developing rollers 53.

By a sheet P that is fed onto the conveying belt 73 passing between the photosensitive drums 51 and the corresponding transfer rollers 74 which are disposed inside the conveying belt 73, the toner images formed on the photosensitive drums 51 are transferred onto the sheet P. Then, by the sheet P passing between the heating roller 81 and the pressing roller 82, the toner images transferred onto the sheet P are thermally fixed.

The sheet discharge part 90 includes mainly a discharge-side conveying path 91 which extends upwards from an exit of the fixing unit 80 to be turned to the front and a plurality of pairs of conveying rollers 92 for conveying a sheet P. The sheet P on which the toner images are thermally fixed is conveyed along the discharge-side conveying path 91 by the pairs of conveying rollers 92 to be discharged out of the apparatus main body 2 for accumulation in the sheet discharging tray 4.

Figure 3:
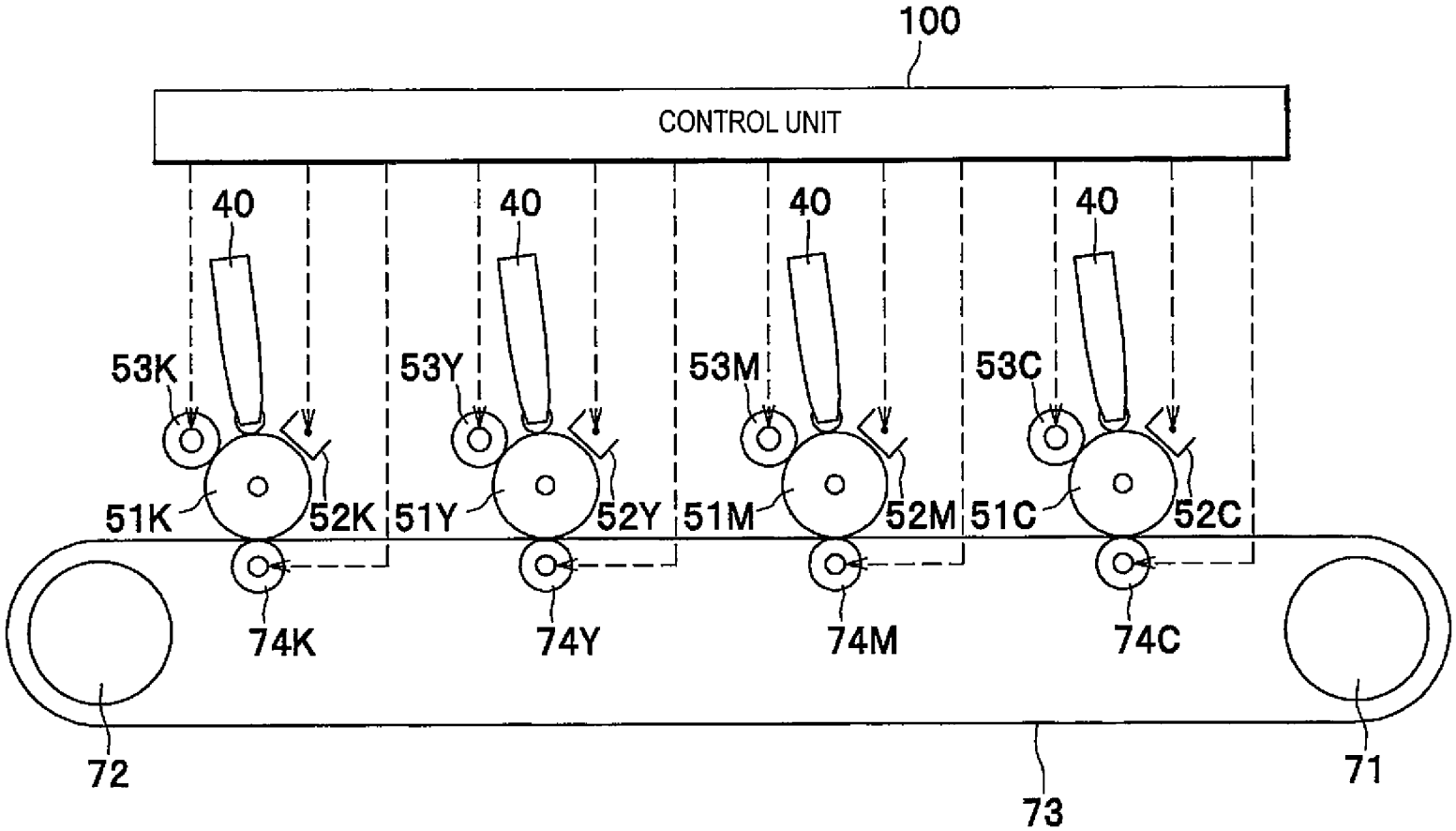
FIG. 3 is a drawing explaining the application of voltage to the developing rollers, chargers and transfer rollers by a control unit.

The control unit 100 has a CPU, ROM, RAM and the like and is made to control the reception of printing data, the feeder unit 20, the image forming unit 30, the sheet discharge part 90 and the connecting/disconnecting mechanism 110 in accordance with a prepared program. Specifically, the control unit 100 can execute a monochrome printing in which a monochromic image is formed on a sheet P (hereinafter, referred to as a monochrome mode) and a color printing mode in which a color image is formed on a sheet P (hereinafter, referred to as a color mode) and controls voltages to be applied to the developing rollers 53, the chargers 52 and the transfer rollers 74 as required in either mode as is shown in FIG. 3.

The control unit 100 controls the chargers 52 so as to change respective electric surface potentials of the photosensitive drums 51 (for example, from 0 V to 760 V), and particularly in the monochrome mode, the control unit 100 executes a special control which will be described below.

<Control of Chargers>

Next, the controlling of charging bias (charging voltage) to be applied to the chargers 52 by the control unit 100 will be described.

Note that in this embodiment, although the invention will be described as being applied to positively chargeable toners, the invention can equally be applied to negatively chargeable toners. The polarity of charging bias is set as required in accordance with the polarity of charged toners. In addition, in this embodiment, voltages are applied to the developing rollers 53 and the transfer rollers 74 as required by the known control, and therefore, the application of voltages thereto by use of the known control will not be described herein.

Charging biases are voltages and currents for controlling electric surface potentials of the photosensitive drums 51. In this embodiment, controlling charging biases is implemented by changing values of currents caused to flow to charging wires 52WK, 52WY, 52WM, 52WC allocated respectively to the four colors. Specifically, the control unit 100 controls charging biases that are applied to the chargers 52 based on a map shown in FIG. 4B so that the electric surface potentials of the photosensitive drums 51 become values shown in FIG. 4A. In this embodiment, while the charging biases are controlled based on currents, charging biases may be controlled so that the electric surface potentials of the photosensitive drums 51 become the values shown in FIG. 4A by controlling voltages that are applied to the charging wires 52W and the grid electrodes 52G based on the predetermined map.

As is shown in FIG. 4, in the color mode, the control unit 100 controls so that all the electric surface potentials of the photosensitive drums 51 take the same value (for example, 760 V) by applying charging biases of the same value to the chargers 52.

If the monochrome mode is executed, the control unit 100 executes an energy saving control in which the values of electric surface potentials of the two downstream-side photosensitive drums 51M, 51C are decreased to values (for example, 760 V) which are lower than those used in color printing with the values of electric surface potentials of the two upstream-side photosensitive drums 51K, 51Y maintained at values which are the same as those used in color printing. Namely, in the energy saving control, the chargers 52 are controlled in monochrome printing so that in the plurality of second and third photosensitive drums, the absolute values of electric surface potentials of the two downstream-side third photosensitive drums 51M, 51C excluding the upstreammost second photosensitive drum 51Y become smaller than the absolute values used in color printing and become smaller than the absolute value of the upstreammost second photosensitive drum 51Y.

In other words, in monochrome printing, the control unit 100 executes the energy saving control in which in the plurality of second and third photosensitive drums 51Y, 51M, 51C, absolute values (for example, 30 μA) of charging biases applied to the chargers 52 corresponding to the two downstream-side third photosensitive drums 51M, 51C excluding the upstreammost second photosensitive drum 51Y become smaller than absolute values of charging biases (for example, 230 μA) applied thereto in color printing and become smaller than an absolute value (for example, 230 μA) of a charging bias applied to the charger 52 corresponding to the upstreammost second photosensitive drum 51Y. Note that it has been verified from experiments that the reverse transfer is restrained by controlling the charging voltages or biases in the way described above.

According to the configuration described heretofore, the following advantage can be obtained in this embodiment.

Since the absolute values (for example, 30 μA) of charging biases corresponding to the two downstream-side third photosensitive drums 51M, 51C excluding the upstreammost second photosensitive drum 51Y in the plurality of second and third photosensitive drums 51Y, 51M, 51C are made smaller than the absolute values of charging biases applied thereto in color printing, the wasteful consumption of electric power can be restrained. In addition, since the absolute value of charging bias corresponding to the upstreammost second photosensitive drum 51Y is made larger than the absolute values of charging biases corresponding the two downstream-side third photosensitive drums 51M, 51C, the reverse transfer of developer to each of the second and third photosensitive drums 51Y, 51M, 51C can be restrained. Note that it is verified from experiments that the reverse transfer is so restrained.

The invention is not limited to the embodiment that has been described heretofore and hence can be used in various forms, which will be described below.

Figure 5:
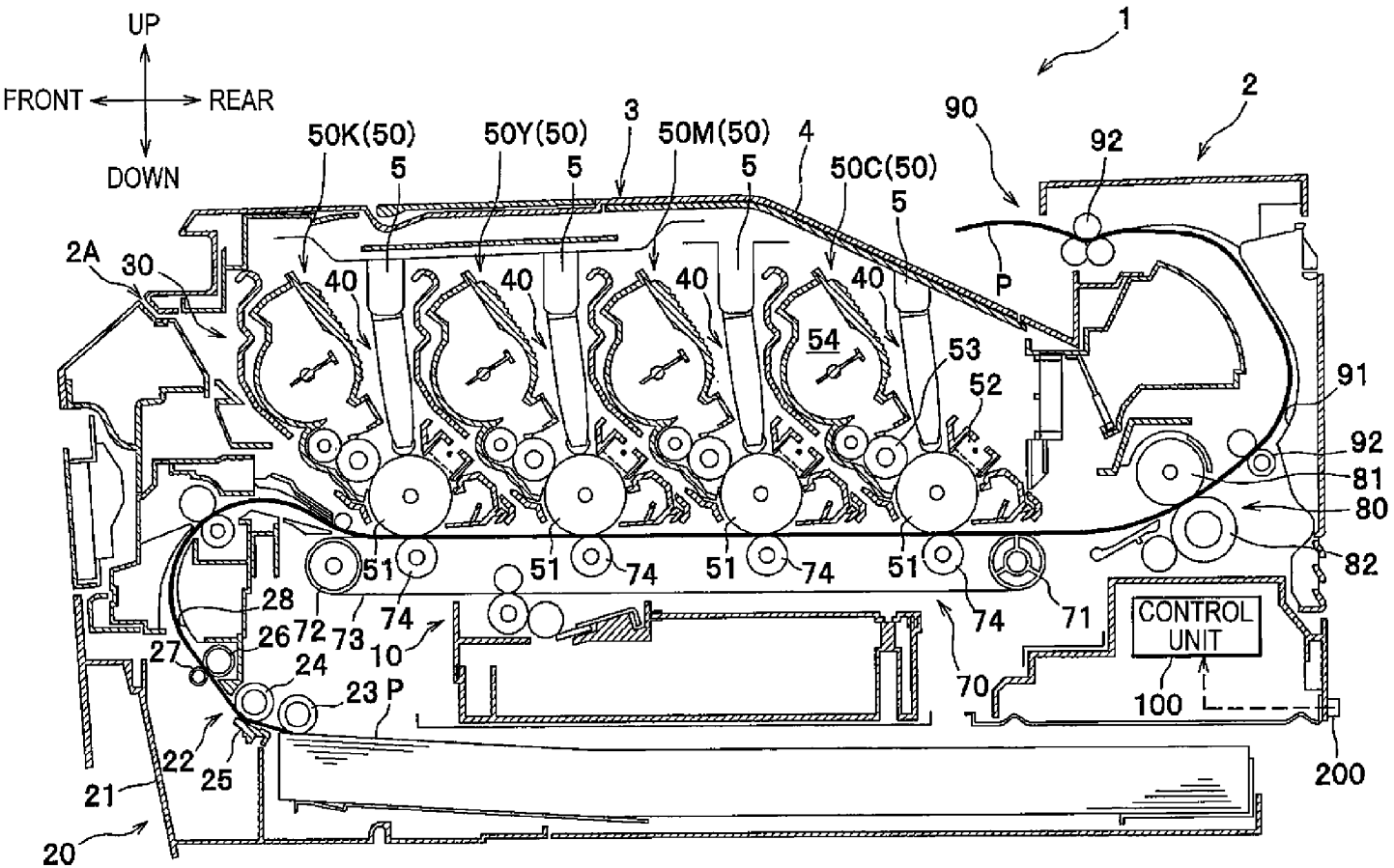
FIG. 5 is a side sectional view showing an image forming apparatus which includes a humidity sensor.

In the embodiment, while the energy saving control is made to be executed at all times in the monochrome mode, the invention is not limited thereto. For example, as is shown in FIG. 5, a humidity sensor 200, which is an example of a humidity detection device, is provided on the apparatus main body 2, and whether to execute the energy saving control may be determined based on a humidity outside the apparatus main body 2 detected by the humidity sensor 200.

Specifically, for example, as is shown in FIG. 6, in the monochrome mode, a configuration may be adopted in which the control unit 100 executes the energy saving control, if the humidity detected by the humidity sensor 200 is smaller than a predetermined value (normal humidity), whereas if the humidity is equal to or larger than the predetermined value (high humidity), the control unit 100 does not execute the energy saving control.

According to this configuration, in the high humidity environment under which the reverse transfer tends to be generated easily on the photosensitive drums for the third color and color thereafter, the reverse transfer can be restrained by executing no energy saving control. As the humidity detection device, a humidity sensor may be adopted which detects humidity inside the apparatus main body.

In the embodiment, while only the charges 52M, 52C corresponding to the third and fourth colors are controlled differently from when in the color mode in the energy saving control, the invention is not limited thereto. In addition to controlling the chargers 52M, 52C for the third and fourth colors, absolute values of transfer biases applied to the transfer rollers 74M, 74C corresponding to the third photosensitive drums 51M, 51C for the third and fourth colors may be made small. According to this configuration, in the energy saving control, although the electric surface potentials of the third photosensitive drums 51M, 51C for the third and fourth colors are changed to potentials of an opposite polarity (the polarity of the transfer biases) by decreasing the electric surface potentials of the third photosensitive drums 51M, 51C for the third and fourth colors, this change in polarity of the electric surface potentials of those photosensitive drums can be restrained by making the transfer biases approach zero.

In the embodiment, while the four photosensitive drums 51 are provided so as to correspond to the toners of four colors, the invention is not limited thereto. For example, when toners come in three colors, three photosensitive drums may be provided so as to correspond to the three colors, or when toners come in five or more colors, five or more photosensitive drums may be provided so as to correspond to those five or more colors.

In the embodiment, while the one photosensitive drum is used to print a black image or the like, the invention is not limited thereto. For example, the three photosensitive drums for yellow, magenta and cyan may be used to print a black image or the like. As this occurs, the three photosensitive drums for those three colors which are used to print a black image or the like correspond to the first photosensitive drum, and other photosensitive drums for other colors (for example, light magenta, light cyan and the like) which are disposed downstream thereof correspond to the second and third photosensitive drums.

In the embodiment, while sheets P are described as functioning as a medium, the invention is not limited thereto. The recording medium may be an intermediate transfer belt, for example. In this case, the moving unit drives and moves the intermediate transfer belt.

In the embodiment, while the chargers 52 having a charging wire are described as functioning as a charging member, the invention is not limited thereto, and hence, the charging member may be, for example, a charging roller which is brought into contact with the photosensitive roller to charge it.

In the embodiment, while the transfer rollers 74 are described as functioning as a transfer device, the invention is not limited thereto, and hence, a transfer device in any form such as a conductive brush or a conductive spring may be adopted as the transfer member, provided that a transfer bias can be applied thereto.

In the embodiment, while the color printer is described as functioning as an image forming apparatus, the invention can also be applied to a multifunction device or a copier.

In the embodiment, while the connecting/disconnecting mechanism 110 is provided, the invention is not limited thereto, and hence, no connecting/disconnecting mechanism may be provided. Even in such a case, an advantage can be exhibited that color mixing in the toner accommodation compartments for the second color and colors thereafter can be restrained by restraining the reverse transfer to the photosensitive drums for the second color and colors thereafter.

What is claimed is:

1. An image forming apparatus for forming an image on a medium, having a monochrome printing mode and a color printing mode, the image forming apparatus comprising:

a first photosensitive drum used in the monochrome printing mode;

a second photosensitive drum used in the color printing mode;

a third photosensitive drum used in the color printing mode, the first photosensitive drum, the second photosensitive drum and the third photosensitive drum being aligned sequentially in this order from an upstream side of a moving direction of the medium;

charger devices provided so as to correspond respectively to the first to third photosensitive drums for charging the photosensitive drums;

transfer devices provided so as to correspond respectively to the first to third photosensitive drums for transferring developer images on the photosensitive drums to the medium fed by a moving unit; and a control unit configured to control charging biases applied to the charger devices and transfer biases applied to the transfer devices, wherein the control unit executes, in the monochrome printing mode, an energy saving control in which an absolute value of a charging bias applied to the charger device corresponding to the third photosensitive drum is smaller than an absolute value of a charging bias applied to the charger device corresponding to the third photosensitive drum in the color printing mode and is smaller than an absolute value of a charging bias applied to the charger device corresponding to the second photosensitive drum in the color printing mode, wherein in executing the energy saving control, the control unit makes smaller an absolute value of a transfer bias applied to the transfer device corresponding to the third photosensitive drums.

2. The image forming apparatus according to claim 1 further comprising a humidity detection device configured to detect humidity, wherein the control unit executes the energy saving control if the humidity detected by the humidity detection device is smaller than a value in the monochrome printing mode, and wherein the control unit executes no energy saving control if the humidity detected by the humidity detection device is equal to or larger than the value in the monochrome printing mode.

3. The image forming apparatus according to claim 1, wherein a plurality of the third photosensitive drums is provided in the image forming apparatus.

4. The image forming apparatus according to claim 1, wherein in the energy saving control, the absolute value of the charging bias applied to the charger device corresponding to the second photosensitive drum in the color printing mode is the same as an absolute value of a charging bias applied to the charger device corresponding to the first photosensitive drum in the color printing mode.

5. The image forming apparatus according to claim 1, wherein the medium is a sheet of paper.

6. An image forming apparatus for forming an image on a medium, having a monochrome printing mode and a color printing mode, the image forming apparatus comprising:

a first photosensitive drum used in the monochrome printing mode;

a second photosensitive drum used in the color printing mode;

a third photosensitive drum used in the color printing mode, the first photosensitive drum, the second photosensitive drum and the third photosensitive drum being aligned sequentially in this order from an upstream side of a moving direction of the medium;

charger devices provided so as to correspond respectively to the first to third photosensitive drums for charging the photosensitive drums;

transfer devices provided so as to correspond respectively to the first to third photosensitive drums for transferring developer images on the photosensitive drums to the medium fed by a moving unit; and a control unit configured to control charging biases applied to the charger devices and transfer biases applied to the transfer devices, wherein the control unit executes, in the monochrome printing mode, an energy saving control in which an absolute value of a charging bias applied to the charger device corresponding to the third photosensitive drum is smaller than an absolute value of a charging bias applied to the charger device corresponding to the third photosensitive drum in the color printing mode, wherein in executing the energy saving control, the control unit makes smaller an absolute value of a transfer bias applied to the transfer device corresponding to the third photosensitive drums.

7. The image forming apparatus according to claim 6 further comprising a humidity detection device configured to detect humidity, wherein the control unit executes the energy saving control if the humidity detected by the humidity detection device is smaller than a value in the monochrome printing mode, and wherein the control unit executes no energy saving control if the humidity detected by the humidity detection device is equal to or larger than the value in the monochrome printing mode.

8. The image forming apparatus according to claim 6, wherein a plurality of the third photosensitive drums is provided in the image forming apparatus.

9. The image forming apparatus according to claim 6, wherein in the energy saving control, the absolute value of the charging bias applied to the charger device corresponding to the second photosensitive drum in the color printing mode is the same as an absolute value of a charging bias applied to the charger device corresponding to the first photosensitive drum in the color printing mode.

10. The image forming apparatus according to claim 6, wherein the medium is a sheet of paper.

11. An image forming apparatus for forming an image on a medium, having a monochrome printing mode and a color printing mode, the image forming apparatus comprising:

a first photosensitive drum used in the monochrome printing mode;

a second photosensitive drum used in the color printing mode;

a third photosensitive drum used in the color printing mode, the first photosensitive drum, the second photosensitive drum and the third photosensitive drum being aligned sequentially in this order from an upstream side of a moving direction of the medium;

charger devices provided so as to correspond respectively to the first to third photosensitive drums for charging the photosensitive drums;

transfer devices provided so as to correspond respectively to the first to third photosensitive drums for transferring developer images on the photosensitive drums to the medium fed by a moving unit; and a control unit configured to control charging biases applied to the charger devices and transfer biases applied to the transfer devices, wherein the control unit executes, in the monochrome printing mode, an energy saving control in which an absolute value of a charging bias applied to the charger device corresponding to the third photosensitive drum is smaller than an absolute value of a charging bias applied to the charger device corresponding to the second photosensitive drum, and wherein in executing the energy saving control, the control unit makes smaller absolute value of a transfer bias applied to the transfer device corresponding to the third photosensitive drums.

12. The image forming apparatus according to claim 11 further comprising a humidity detection device configured to detect humidity, wherein the control unit executes the energy saving control if the humidity detected by the humidity detection device is smaller than a value in the monochrome printing mode, and wherein the control unit executes no energy saving control if the humidity detected by the humidity detection device is equal to or larger than the value in the monochrome printing mode.

13. The image forming apparatus according to claim 11, wherein a plurality of the third photosensitive drums is provided in the image forming apparatus.

14. The image forming apparatus according to claim 11, wherein in the energy saving control, the absolute value of the charging bias applied to the charger device corresponding to the second photosensitive drum in the color printing mode is the same as an absolute value of a charging bias applied to the charger device corresponding to the first photosensitive drum in the color printing mode.

15. The image forming apparatus according to claim 11, wherein the medium is a sheet of paper.

* * * * *